United States Patent [19]

Curtin

[11] 3,954,603

[45] May 4, 1976

[54] METHOD OF REMOVING CONTAMINANT FROM HYDROCARBONACEOUS FLUID

[75] Inventor: Daniel J. Curtin, Plano, Tex.

[73] Assignee: Atlantic Richfield Company, Los Angeles, Calif.

[22] Filed: Feb. 10, 1975

[21] Appl. No.: 548,512

[52] U.S. Cl. ..... 208/253; 208/251 H

[51] Int. Cl.[2] ..... C10G 29/04

[58] Field of Search ..... 208/253, 91, 251 H

[56] References Cited

UNITED STATES PATENTS

| | | | |
|---|---|---|---|
| 3,183,178 | 5/1965 | Wolk | 208/251 H |
| 3,496,099 | 2/1970 | Bridge | 208/251 H |
| 3,530,066 | 9/1970 | Kuwata et al. | 208/251 H |
| 3,817,855 | 6/1974 | Smith et al. | 208/253 |
| 3,838,042 | 9/1974 | Beuther et al. | 208/253 |
| 3,876,533 | 4/1975 | Myers | 208/251 H |

*Primary Examiner*—Delbert E. Gantz
*Assistant Examiner*—James W. Hellwege
*Attorney, Agent, or Firm*—Roderick W. MacDonald

[57] ABSTRACT

A method of removing a catalyst-poisoning contaminant, such as arsenic or selenium, from a hydrocarbonaceous fluid, such as a synthetic crude, characterized by a multi-step process as follows. First, at least two guard beds are prepared from a plurality of particles of material that is either iron, cobalt, nickel, oxides, or sulfides of these metals or mixtures thereof. Next, the synthetic crude oil is admixed with hydrogen at a superatmospheric pressure of at least 500 pounds per square inch gauge (psig) and flowed past the particles serially through the guard beds, contacting the particles in the first bed at a temperature in the range of from about 300° to about 550°F and contacting the particles in the second and subsequent guard beds at a temperature greater than said first bed and greater than 550° and up to about 850°F. Some reduction in the concentration of the contaminant is effected in the first, low temperature guard bed. A generalized distribution of the contaminant over a major part of the low temperature guard bed is effected, instead of a high concentration in the first part of the bed to be contacted. Surprisingly, the low temperature bed effects a more general deposition of the contaminant on the second, high temperature bed, and prevents flow-blocking concentration in the first part of the high temperature guard bed. Also disclosed are specific process details, including a preferred type of material.

13 Claims, 1 Drawing Figure

METHOD OF REMOVING CONTAMINANT FROM HYDROCARBONACEOUS FLUID

BACKGROUND OF THE INVENTION

1. Field of the Invention

This invention relates to a method of removing catalyst-poisoning impurities, or contaminants; such as, arsenic or selenium; from hydrocarbonaceous fluids, such as synthetic crude oil and synthetic oil fractions.

2. Description of the Prior Art

There has been a resurgence of interest in sources of energy that were formerly not competitive. These sources of energy include shale oil, such as derived from oil shale; the fluids, such as methanol or coal gas, that are synthesized from coal; the bitumen from the tar sands and the like. Frequently, these fluids are lumped together under generic terms like "hydrocarbonaceous fluids," "synthetic crude oil," or "synthetic oil fractions." Some of these hydrocarbonaceous fluids contain contaminants that would poison expensive catalysts, such as platinum catalysts and the like, that are used in hydrogenation and other processes to which these hydrocarbonaceous fluids must be subjected before they can be satisfactorily used as sources of energy. Even if the hydrocarbonaceous fluids are employed directly as fuels, the removal of the contaminants may be desirable for environmental protection. Consequently, the contaminants must be removed, or have their concentration lowered to an acceptable level.

The prior art has included methods of removing arsenic from hydrocarbon charge stocks, such as described in U.S. Pat. No. 2,778,779. Such methods have included the using of iron, nickel and cobalt oxides to remove arsenic from streams of naturally occurring crude; for example, naphtha or straight run gasoline. In that process, the oxides were employed at a low temperature, such as from room temperature to about 200°F, without regard to the atmosphere under which the reaction takes place and with substantial amounts of water, the oxide acting as an oxidizing agent and oxidizing the arsenic to a water soluble arsenic oxide. In this way, the arsenic oxide is dissolved in the water and removed from the naturally occurring crude oil or oil fraction.

Also, as disclosed in U.S. Pat. No. 2,781,297, arsenic has been removed from similarly naturally occurring crude oils by contacting them with a metallic salt of a strong acid at low temperature, such as room temperature, without regard to the atmosphere under which the contacting takes place. In this particular process, it was taught that oxides do not work for removing arsenic.

One of the most pertinent patents of which we are aware is U.S. Pat. No. 3,496,099, which describes the catalytic hydrogenation of hydrocarbons to effect the precipitation of an insoluble iron salt of the iron porphyrin within a hydrogenating catalyst that increases in concentration longitudinally and concurrently with the flow of the feed; the feed being naturally occurring hydrocarbons.

SUMMARY OF THE INVENTION

Accordingly, it is an object of this invention to provide a method of removing contaminants from a feed stream of hydrocarbonaceous fluid, such as synthetic crude, or a fraction thereof, or the like, that does not require the use of aqueous, or hydrophilic, solutions, and alleviates the difficulties of the prior art.

More specifically, it is an object of this invention to provide a method of removing a contaminant from a feed stream that accomplishes the foregoing object and provides stable guard beds that maintain a continuous high level of activity, yet can be operated with economically feasible equipment over a prolonged interval without plugging.

These and other objects will become apparent from the descriptive matter hereinafter and the appended drawings.

The foregoing objects are achieved in accordance with this invention by the following multi-step process. First, a plurality of guard beds are prepared. At least one of the guard beds is a low temperature bed and at least one of the remaining beds is a high temperature bed. Each bed consists essentially of a plurality of porous particles of a contaminant-removing material selected from a group consisting of iron, cobalt, nickel, at least one oxide or sulfide of the metals or a combination of two or more thereof. The contaminant-removing material may comprise the named active materials alone; or preferably, carried on a strong carrier that maintains its structural integrity under the conditions of contact with the feed. Suitable carrier material includes silica, alumina, magnesia, zirconia, thoria, zinc oxide, chromium oxide, silicon carbide, naturally occurring carrier such as the clays, including special clay like Fuller's earth; Kieselguhr; pumice; bauxite and the like, combinations of two or more thereof, whether naturally occurring or prepared. Preferably, the carrier materials are specially treated or activated, to have at least one of high pore volume of at least 0.8 cubic centimeters per gram (cc/gm) with a major portion of pore radius greater than 100 Angstroms (A), and feeder pores greater than 1,000A in radii. In any event, the contaminant-removing material must be operable to effect deposition of the contaminant within the particles of the bed when contacted by the hydrocarbonaceous feed containing the contaminant under a superatmospheric reducing atmosphere, such as in the presence of hydrogen at at least 500 psig, and at a temperature in the range of from about 300° to about 850°F. Next, the hydrocarbonaceous fluid making up a feed stream is admixed with a reducing medium such as hydrogen to form an admixture of feed streams. The admixture is then flowed serially through the guard beds; first through the low temperature bed into contact with the particles of material at a first and relatively low temperature $T_L$ in the range of from about 300° to about 550°F to effect a reduction in the concentration of the contaminant in the hydrocarbonaceous fluid and deposition of the contaminant over a major portion of the low temperature guard bed instead of a high concentration in the first part of the low temperature bed to be contacted. Thereafter, the effluent from the low temperature bed comprising the admixture with the reduction in the concentration of contaminant, is flowed into contact with the at least one high temperature guard bed at a second and relatively high temperature $T_H$ in the range of from about 550° to about 850°F. The concentration of the contaminant is thereby reduced to a predetermined acceptable level. The contaminant is deposited over a major portion of the high temperature guard bed, instead of a high and flow-blocking concentration in the first part of the high temperature guard bed to be contacted, and is also deposited within the particles in said high temperature guard bed instead of in the voids between said particles. The conditions of contact of the hydrocarbonaceous fluid having the contaminant with the contaminant-removing material includes a substantial absence of water such that the contaminant is deposited in the particles in a water-insoluble form. By "substantially no water" or "substantial absence of water" is meant less than 1.0, preferably, less than 0.1, percent by weight of water in the synthetic oil, or hydrocarbonaceous fluid, to be treated.

For both beds, the conditions of contact also include a superatmospheric pressure under a reducing atmosphere, such as at least about 500 psig partial pressure of hydrogen. Preferably, the conditions of contact comprise a hydrogen partial pressure of at least about 1,000 psig.

The manner in which the contaminants are removed from the hydrocarbonaceous fluid is not entirely clear. It is possible but not known to a certainty that the contaminant-removing material is involved as a catalyst in effecting a decomposition of organic compounds of the contaminants, such as organo-arsenic compounds. Analysis of the spent material employing iron oxide on a carrier material shows the presence of iron arsenide compounds, such as $FeAs_2$ and FeAs. Consequently, it appears clear that the active material is also involved as a reactant. In addition, it is possible that it acts as an adsorbent, since the arsenic in analyzed beds will show up, not only in the matrices of the structure, but deposited on the surfaces of the particles. Accordingly, the terminology of "effecting deposition of the contaminant within the material" will be employed to connote this apparently complex and inadequately explicable phenomena of the removal of the contaminant. It is sufficient to note, however, that the invention works whether the theories are correct or not and this invention is not to be limited to the consequences of any theory.

DESCRIPTION OF PREFERRED EMBODIMENTS

Figure 1:
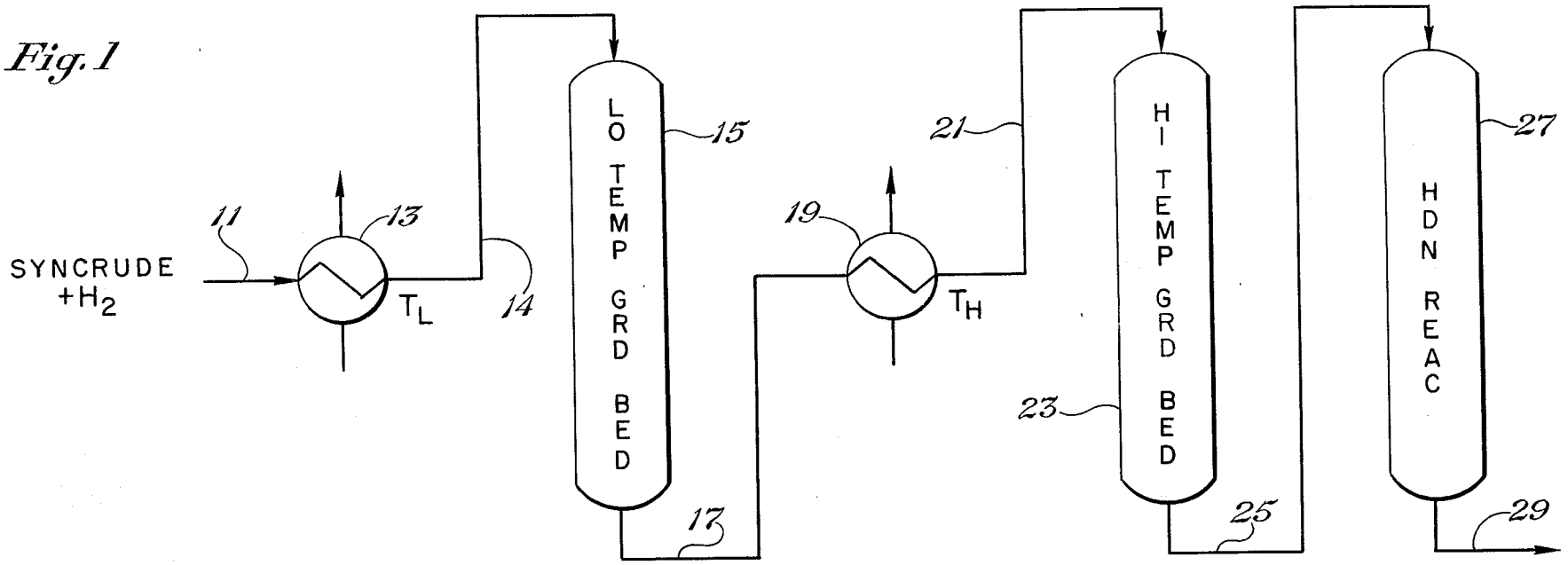

To facilitate understanding, the treatment of a stream of a synthetic crude oil obtained from oil shale, normally solid coal, tar, or tar sands, commonly referred to collectively (including fractions thereof) as syncrude, with the particles of material for removing the contaminant will be described hereinafter.

In carrying out the invention as outlined hereinbefore, the guard beds are formed by depositing pellets, or other particles, of the material into respective pessure vessels. The guard beds are labeled in the FIGURE as low temperature guard bed (LO TEMP GRD BED) and high temperature guard bed (HI TEMP GRD BED), respectively. The vessels are adapted to withstand the pressure and temperature necessary to effect the removal of the contaminant, arsenic or selenium, whether in elemental or combined form. The particles of material may have any shape and any of the sizes that are employable in this art. Specifically, the particles must not be so small as to pack into a flow blocking mass or so large as to render internal area of the particles of contaminant-removing material inaccessible to the fluid and contaminant. Ordinarily, the particles of material will comprise extrudates or pellets of from 1/32 to ¼ inch or more in diameter and ⅛ inch or more in length; or spheroidal particles within the diameter range of 1/32 to ¼ inch.

The contaminant-removing material may comprise active material, alone, or carried by a carrier material, as indicated hereinbefore. The active materials of the contaminant-removing material are delineated hereinbefore, also. As regards the oxides and sulfides of the metals set forth hereinbefore as the active material, the ferric, nickelic, cobaltic, ferrous, nickelous and cobaltous forms can be employed. For example, ferric oxides, both $Fe_2O_3$ and $Fe_3O_4$; nickelic oxides $Ni_2O_3$ and $Ni_3O_4$ and cobaltic oxides $Co_2O_3$ and $Co_3O_4$ can be employed. Similar reasoning is applicable to the comparable sulfides of the metals and to the ferrous, cobaltous and nickelous forms of the oxides and sulfides.

The particles of contaminant-removing material, supported or nonsupported, preferably have a surface area of at least 1 square meter per gram ($m^2$/gm), preferably at least 50 square meters per gram. Suitable carrier materials are available having high pore volume of at least 0.8; for example, 0.98 up to 1.5 cubic centimeters per gram; and having surface areas of from 240 to 360 square meters per gram. Preferably, the contaminant-removing material has feeder pores greater than 1,000 A in radii running therethrough for flow therethrough of the hydrocarbonaceous fluid and contaminant; and have active material disposed adjacent the pores for contacting the hydrocarbonaceous fluid and contaminant for effecting deposition of the contaminant within the contaminant-removing material and removal of the contaminant from the hydrocarbonaceous fluid feed. Two particularly suitable contaminant-removing materials comprise: (1) a co-precipitated catalyst having the material co-precipitated with and uniformly distributed throughout a carrier material, such as alumina; and (2) an active material carried by a high pore volume carrier material, such as gamma alumina, and having feeder pores running therethrough. It is sufficient to note herein that the latter material has feeder pores formed by admixing fillers, including carbon or an organic filler, such as cellulose fibres, before the particles of a material and carrier material are formed, as by extrusion of the pellets or dropping of spheroidal particles through a medium. The fillers are then burned away during calcination in an oxidizing atmosphere to leave the continuum of feeder pores. The feeder pores allow access of the hydrocarbonaceous fluid and contaminant to the interior portions of all the particles for best results. Any other material having the capability of effecting deposition of the contaminant in the interstices and in the particles of the contaminant-removing material and decreasing the concentration of the contaminant in the hydrocarbonaceous fluid feed stream may be employed in this invention as long as the particles of material are economically feasible.

After the syncrude, as illustrative of the hydrocarbonaceous fluid, has been admixed with hydrogen, the resulting admixture is flowed into contact with the particles of material in the low temperature guard bed. Sufficient heat, pressure and space time are afforded to effect removal of at least a minor portion of the contaminant from the syncrude and effect deposition of the contaminant into the particles of material. Space time is defined as the reciprocal of weight hourly space velocity, described hereinafter. The contacting of the admixture and the particles of material is at a temperature of at least 300°F and no more than 550°F. Preferably, the contacting in the low temperature guard bed is at a temperature in the range of 400°–500°F; for example, about 475°F.

The temperature may be effected by heating the constituents, such as the syncrude and the hydrogen, individually before admixing, supplying heat to the admixture directly, or supplying heat to the guard bed. Ordinarily, it is advantageous to heat the fluid streams. Preferably, the fluid streams are heated upstream of the vessel 15 by conventionally employed heaters, such as directly fired or indirectly fired heat exchangers. The guard bed pressure vessel is suitably insulated to prevent significant heat losses. The contacting is effected at a reaction severity sufficient to achieve the desired removal of the contaminant. One variable of reaction severity may be expressed in "space time" or its reciprocal "weight hourly space velocity" (WHSV). Herein, such reaction severity is generally, at least 100 WHSV to 2 WHSV. The weight hourly space velocity is the rate of flow in weight per hour of hydrocarbonaceous fluid divided by the weight of contaminant-removing material in the bed. At lower WHSV's the breakthrough of a contaminant may be delayed until the bed, or sections, of particles of material, is more nearly completely used up; whereas at high WHSV's, the contaminant may break through before the capacity of the bed is reached. The desired atmosphere is provided by molecular hydrogen being present as the feed contacts the particulate material in the respective beds. The reaction severity conditions may be effected by a single large guard bed or plurality of serially and/or parallel connected smaller and less expensive guard beds.

Thus, the delineated heat, pressure and space time allows sufficient reaction severity for the syncrude to intimately contact the particles of material and to effect removal of at least a minor portion of the contaminant and deposition of the contaminant throughout the low temperature bed because of the low temperature. Specifically, the contaminant, such as arsenic, is dispersed in a widespread manner throughout substantially the whole low temperature guard bed rather than being deposited in the first part of the guard bed to be contacted. Moreover, the contaminant is removed in a water insoluble form.

The low temperature bed may initially effect a relatively large decrease in concentration; but after a few days of use will effect only a minor reduction in the concentration of the contaminant and a generalized distribution of the contaminant throughout the low temperature bed. For example, the low temperature guard bed may initially remove 30 of 45 parts per million or more of the arsenic; but will, ordinarily, remove only about 10–15 parts per million after a few days of operation. The removal of the minor portion of the concentration of the contaminant will continue at a constant level, however, for a prolonged interval of a month or more without plugging of the bed and without adversely failing to remove the minor amount of contaminant and prepare the syncrude stream for contact with the high temperature bed.

The effluent from the low temperature guard bed is then flowed into contact with the high temperature guard bed under substantially the same pressure. The temperature is higher than that of the low temperature bed and in the range of greater than 550° and up to about 850°F. Preferably, the temperature is in the range of from about 650° to about 750°F; for example, about 700°F. The WHSV may be the same as or greater than that of the low temperature bed, but preferably, is less. This reaction severity effects the desired removal of the contaminant from the syncrude. Expressed otherwise, the concentration of contaminant is reduced to a tolerable level of only about 1 to 2 parts per million (ppm). Moreover, when breakthrough of contaminate occurs thus terminating the cycle of use, the contaminant is deposited substantially throughout the high temperaure guard bed — not in a high concentration in a first part of the bed to be contacted. With the prior art, the high concentration in the first part of the bed has been found to be so severe that intolerably high pressure drops are encountered after only a few days of operation, as will be delineated more clearly in the examples hereinafter. As described with the low temperature guard bed, the contaminant is removed in water insoluble form and deposited throughout the bed.

The WHSV for reaction to take place on the high temperature bed, may be provided by a single large guard bed or a plurality of serially and/or parallel connected smaller and less expensive guard beds. The delineated heat, pressure and WHSV allow sufficient time for the syncrude to intimately contact the particles of material in the high temperature guard bed and to have the contaminant removed from the syncrude. Expressed otherwise, at least an acceptably low level of concentration of contaminant is reached in the effluent stream. Such an acceptably low level may be only about 1–2 parts per million.

Operation of this invention may be understood by referring to the flow diagram of the FIGURE. Therein, the syncrude plus hydrogen comprises two streams that have been admixed, however, to form a single stream that flows through incoming conduit 11. One or more of the respective streams may have been heated, may be heated, or may be cooled to a temperature such that the admixture will be at the desired temperature. As illustrated, the admixed stream of syncrude and hydrogen is heated in heat exchanger 13 to a predetermined first and relatively low temperature $T_L$; for example, about 475°F. The heat exchanger 13 may be any of the conventionally employed heaters, indirectly fired or directly fired. Illustrative of the indirectly fired heat exchangers are the salt-bath heat exchangers in which a molten bed of salt is heated by burning a fuel in the combustion chamber and, in turn, transfers the heat into the admixed stream via suitable tubing or shell-type heat exchanger. In the directly fired heat exchangers, the admixed fuel stream is flowed through tubing that is exposed directly to the heat from the combustion chamber, in the exhaust gases and the like, in the nature of the conventional boiler, rich oil heater, or the like. These rich oil heaters are conventional and this lengthy specification need not be lengthened to describe such conventional art.

In any event, the heated admixture of syncrude and hydrogen then flows through conduit 14 to the low temperature guard bed 15. This invention is not to be limited to the consequences of any theory, since the delineated final results are achieved. It is theorized, however, that the low reaction severity effects removal and deposition of the more reactive portion of the contaminant. While the more reactive portion of the contaminant may be only a minor portion of the total contaminant in the hydrocarbonaceous fluid, it will plug a bed if contacted at the higher temperature $T_H$. This more reactive portion of the contaminant is removed from the syncrude and by the end of the cycle of use is deposited substantially throughout the low temperature guard bed.

The effluent stream of syncrude and hydrogen having a minor portion of the contaminant removed, flows out conduit 17. Heat may be added by a supplemental stream of hot gas; for example, hot hydrogen. As illustrated, the effluent admixture is heated in heat exchanger 19 to a second and relatively high temperature $T_H$; for example, about 700°F. The heat exchanger 19, similarly as described with respect to exchanger 13, may comprise any of the conventionally employed heat exchangers to obtain this temperature. For example, the heat exchanger 19 may comprise any of the indirectly fired or directly fired heat exchangers described hereinbefore. The heated admixture flows, via conduit 21, to the high temperature guard bed 23.

In the high temperature guard bed 23, the contaminant is removed from the syncrude and deposited substantially throughout the guard bed, not in only the surface layers and not in only the first portion of the guard bed contacted. The reason for the efficacy of the two bed system in allowing the beds to run for a month or more without having to change out the particles of material; instead of only a few days before plugging occurred; is not entirely clear. While, as indicated, this invention is not to be limited to the consequences of any theory, since it works regardless of whether the theory is correct or not; it is theorized that the low temperature guard bed and the contact between the particles of material and the contaminant in the syncrude and hydrogen stream effects a reaction-like phenomena whose kinetics are slowed by the lower temperature. Since the more readily deposited contaminant has been initially removed, however, the portion of the contaminant remaining after the minor reduction in concentration is more difficultly removed. Consequently, the deposition of contaminant occurs throughout the high temperature bed even at the high temperature. In the prior art processes, contact with the high temperature bed at the high temperature resulted in bed plugging. The plugging was due at least in part to a high concentration of deposited contaminant in the first part of the bed contacted.

As described hereinbefore, one or more high temperature guard beds may be employed. When a plurality of high temperature guard beds are employed, they may be connected serially or in parallel to obtain either the requisite capacity or the requisite low concentration of contaminant in the effluent stream. Ordinarily, a single high temperature guard bed has been found adequate to reduce the concentration of contaminant in the effluent stream conduit 25 to about 1–2 parts per million. If desired, additional particles of the same or different material may be employed on the effluent end of the high temperature guard bed to reduce the concentration of contaminant in the effluent stream to any desired predetermined concentration. The predetermined concentration will depend upon the economics of the cost of such additional particles of material versus the cost of any minor catalyst poisoning that may occur in any subsequent reaction such as a hydrogenation reaction.

Any amount of the particles of material can be employed in either of the low temperature guard bed 15 or high temperature guard bed 23. A predetermined volume of fluid, based on contaminant concentration therein and bed capacity, is flowed through the guard beds, and then the fluid is routed to another bed containing fresh material for treating the fluid. This is referred to as switching the beds. Preferably, the capacity of the respective guard beds is matched to enable single switching of respective sets of respective guard beds. The predetermined volume can be determined theoretically or empirically. On the other hand, the effluent stream from each of the guard beds can be monitored for the contaminant concentration and if the contaminant is detected in a concentration larger than the predetermined concentration, the guard beds can be "switched out" and the admixture of hydrogen and syncrude routed through another set of respective guard beds. The particles of material in the spent guard beds are thereafter changed out and replaced by fresh materials or regenerated.

Referring again to the FIGURE, the effluent stream of the syncrude without the intolerably high concentration of contaminant therein and the hydrogen are then transported via conduit 25 to the hydrogenation reactor (HDN REAC) 27. In the hydrogenation reactor 27, hydrogenation conditions are employed in accordance with conventional practice, and the hydrogenated stream will effluent via conduit 29. This conventional hydrogenation is well known and described in a plurality of texts; including KIRK-OTHMER ENCYCLOPEDIA OF CHEMICAL TECHNOLOGY, Second Edition, Anthony Standen, editor, Interscience Publishers, New York, 1969; and that material is incorporated by reference for details omitted herefrom. It is sufficient to note that a plurality of feed streams may be employed depending upon the end results desired to be achieved in accordance with this conventional technology.

The following Example is provided to illustrate the advantages of this invention:

EXAMPLE

A gas oil having a boiling point range of 400°–950°F and have 45 parts per million arsenic was employed as the hydrocarbonaceous fluid having a catalyst-poisoning contaminant. The beds were formed of particles of a material comprising an admixture of gamma alumina having about 25 percent (%) ferric oxide uniformly distributed throughout and having feeder pores running therethrough. Calculations had indicated the beds would operate about a month in a pilot plant at a predetermined flow rate per unit bed volume capacity. After only a few days of operation at about 700°F, however, the bed became plugged. Pressure drop at this time was 450 pounds per square inch (psi). When the bed was sectioned, it was found that the material had a high concentration of arsenic containing solids deposited in the interstices between the pellets in the top of the bed, the first part to be contacted with the hydrocarbonaceous fluid and contaminant. Moreover, the concentration of contaminant was high, being about 30 percent arsenic in the top portion of the bed.

In accordance with this invention, a low temperature guard bed was first established upstream of a high temperature guard bed. Hydrocarbonaceous fluid containing the hydrogen was pre-heated to a plurality of temperatures on different runs with the results indicated in the Table. Thereafter, the effluent from the low temperature guard bed was pre-heated up to a second and relatively high temperature and flowed through the high temperature guard bed.

TABLE

| Run No. | Temp. $T_L$ | Lo Temp. Grd. Bed* | Temp. $T_H$ | Hi Temp. Grd. Bed* |
|---|---|---|---|---|
| 1 | | no bed | 700 | undesirably high pressure drop of about 450 psi |
| 2 | 400 | no plugging | | |
| 3 | 475 | no plugging | 700 | no plugging |
| 4 | 550 | undesirably high pressure drop of about 100 psi | 700 | no plugging |

*Comprising particles of alumina having, initially, about 25 percent by weight of $Fe_2O_3$ distributed substantially uniformly throughout and having feeder pores running therethrough As can be seen from the table, temperatures in the range of 400°–550°F in the low temperature bed can be employed in this invention. Better results were obtained, however, when temperature of about 475°F was employed in the low temperature bed. Under these optimum conditions, after 26 days holding the low temperature bed near the optimum temperature of 475°F and the high temperature bed at about 700°F there was only 50 psi pressure drop increase across the high temperature bed and essentially no pressure drop increase across the low temperature bed.

The arsenic concentration was initially lowered from 45 ppm in the feed stream to about 15 ppm in the effluent from the low temperature bed; but in a few days the arsenic in the effluent stream was about 35 ppm where it remained for the remainder of the test.

The effluent stream from the high temperature bed was about 1–5 parts per million and remained at this level throughout the test.

When the low and high temperature beds which were operated in accordance with this invention were sectioned, they both showed essentially no arsenic containing solids to be deposited in the interstices between the bed particles but did show a substantial amount of arsenic deposited internally in the bed particles themselves.

From the foregoing it can be seen that this invention effects the objects set out hereinbefore and alleviates the difficulties of the prior art processes.

Having thus described this invention, it will be understood that such description has been given by way of illustration and example and not by way of limitation, reference for the latter purpose being had to the appended claims.

What is claimed is:

1. A method of removing a contaminant comprising at least one of arsenic and selenium from a hydrocarbonaceous fluid comprising the steps of:

a. preparing a plurality of beds comprising at least one low temperature bed and at least one high temperature bed, each bed having essentially only porous particles therein which contain a contaminant-removing material selected from the group consisting of iron, cobalt, nickel, at least one oxide of the named metals, at least one sulfide of the named metals, and combinations of two or more thereof; said material being operable to effect removal of at least a portion of said contaminant from said hydrocarbonaceous fluid under a reducing atmosphere at a temperature of from about 300° to about 850°F;

b. mixing said hydrocarbonaceous fluid with a reducing medium;

c. flowing the resulting mixture in the substantial absence of water into contact with said at least one low temperature bed at a first temperature of from about 300° to about 550°F to remove contaminant from said hydrocarbonaceous fluid and deposit the removed contaminant within the particles in said low temperature bed instead of in the interstices between said particles; and, thereafter, d. flowing the effluent of said low temperature bed in the substantial absence of water into contact with said at least one high temperature bed at a temperature greater than said low temperature bed and in the range of from about 550° to about 850°F to effect a further reduction of the concentration of said contaminant in said hydrocarbonaceous fluid and deposit additional contaminant within the particles in said high temperature bed instead of in the interstices between said particles.

2. The method of claim 1 wherein said material comprises a plurality of particles of a carrier material carrying said material and having feeder pores for allowing said hydrocarbonaceous fluid and said contaminant to contact substantial amounts of said particles internally thereof.

3. The method of claim 1 wherein said first temperature is from about 400° to about 500°F.

4. The method of claim 3 wherein said second temperature is from about 650° to about 750°F.

5. The method of claim 1 wherein said admixture is preheated to a temperature of from about 400° to about 500°F before being flowed through said low temperature bed in accordance with step (c) and is preheated to a temperature of from about 650° to about 750°F before being flowed through said high temperature bed in accordance with step (d).

6. The method of claim 1 wherein said reducing medium is hydrogen.

7. The method of claim 1 wherein said particles have a pore volume of at least 0.8.

8. The method of claim 1 wherein said particles have feeder pores greater than 1,000 Angstroms in radii running therethrough for flow therethrough of said hydrocarbonaceous fluid.

9. The method of claim 1 wherein said hydrocarbonaceous fluid is a synthetic crude or one or more fractions thereof.

10. The method of claim 1 wherein said contaminant-removing material is supported on a carrier material.

11. The method of claim 10 wherein said carrier material is selected from the group consisting of silica, alumina, magnesia, zirconia, thoria, zinc oxide, chromium oxide, clay, Kieselguhr, Fuller's earth, pumice, bauxite, and combinations of two or more thereof.

12. The method of claim 10 wherein said carrier has a pore volume of at least 0.8.

13. The method of claim 10 wherein said carrier has feeder pores greater than 1,000 Angstroms in radii therethrough.

* * * * *